United States Patent [19]

Branscum

[11] 4,372,453

[45] Feb. 8, 1983

[54] CONTAINER HOLDER

[75] Inventor: Tony E. Branscum, Winfield, Kans.

[73] Assignee: Gott Corporation, Winfield, Kans.

[21] Appl. No.: 314,564

[22] Filed: Oct. 26, 1981

Related U.S. Application Data

[63] Continuation of Ser. No. 148,391, May 9, 1980, abandoned.

[51] Int. Cl.[3] ..... B65D 23/08; B65D 81/38; A47J 41/00

[52] U.S. Cl. ..... 215/13 R; 220/82 R; 220/85 H; 220/256; 220/412; 215/100.5

[58] Field of Search ..... 215/13 R, 100.5; 220/82 R, 85 H, 256, 410, 412, 413

[56] References Cited

U.S. PATENT DOCUMENTS

| | | | |
|---|---|---|---|
| 402,679 | 5/1889 | Leggett | 220/256 |
| 3,120,570 | 2/1964 | Kennedy | 215/13 R |
| 3,285,455 | 11/1966 | Pewitt | 215/100.5 |
| 3,298,558 | 1/1967 | Nichol | 220/82 R |
| 3,977,552 | 8/1976 | Lombardo | 215/13 R |
| 4,047,633 | 9/1977 | Trombly | 220/82 R |
| 4,163,374 | 8/1979 | Moore | 220/85 H |

*Primary Examiner*—George E. Lowrance
*Attorney, Agent, or Firm*—Kokjer, Kircher, Bradley, Wharton, Bowman & Johnson

[57] ABSTRACT

An insulated beverage container holder is the subject of the present invention. A cylinder support for receiving the container is provided with insulating material, such as rigid foam, or may be of double wall construction to provide thermal insulation. The top of the support is provided with an opening which is eccentric relative to the center of the support. A pivotal cap is received by the support and has an opening which overlies the first mentioned opening. The cap opening is also eccentric relative to the center of the support but is movable from a first position wherein the two openings are in concentric alignment to a non-aligned position. When the openings are aligned, a container may be inserted in the support. Preferably, the openings are large enough to accommodate beverage cans or other containers of different size. After the container is inserted, the cap is pivoted thereby causing the container to be gripped between the edges of the opening at the top of the support and the edges of the opening in the pivotal cap.

8 Claims, 7 Drawing Figures

CONTAINER HOLDER

BACKGROUND OF THE INVENTION

This is a continuation of Ser. No. 148,391, filed May 9, 1980, now abandoned.

This invention relates generally to container holders and, more particularly, to a container holder which will firmly grip the container but is releasable to allow insertion and removal of the container.

Various types of container holders have long been popular for cans and glasses, particularly where the object being held is a cold drink. Oftentimes these "coaster" type devices are provided with some type of insulation so as to help keep the container being held cool. Another advantage of using this type of device is that the person drinking from the container does not have to touch the container which, because of the warm air striking the cool container, will cause moisture to condense and run down the sides.

Many of the prior art coaster devices are relatively lightweight in construction and not designed for a long life. They are usually inexpensive to purchase at the outset but have to be replaced after significant usage. Another inherent problem with the prior art coaster devices is that they are not designed to accommodate containers of different sizes. The only exception to this known by the present applicant is a can holder which is provided with a collar having flexible "fingers" projecting from it so that when a can is inserted the "fingers" will flex to some degree to accommodate cans of different sizes. Even this type of device is very limited as to the variations in size which it can accommodate and after repeated usage with a relatively large can the device loses its ability to grip smaller cans. Because of the friction fit and the inability to release the grip of the "fingers" except by force, it is also difficult to remove a can once it has been inserted in the device.

SUMMARY OF THE INVENTION

The present invention provides for the first time a container holder which is capable of releasably gripping different size containers thus allowing for easy insertion and removal but also assuring a tight fit.

It is, therefore, a primary object of the present invention to provide a device for holding a cylindrical container which will firmly and releasably grip the object being held.

Another object of the invention is to provide a container holder which will releasably grip the object being held and is also capable of gripping different size containers.

It is also an important aim of the invention to provide a container holder as described in the foregoing objects which is constructed of substantially permanent material thereby being reusable and more economical than prior art devices.

An objective of the invention is also to provide a container holder as described in the aims and objects set forth above which will provide good thermal insulation between the inside and the outside of the holder.

As a corollary to the primary object of the invention set forth above, it is an aim of the invention to provide a container holder which may be constructed of translucent material thereby accommodating advertising or decorative indicia inside of the outer wall of the holder where the indicia will remain substantially permanent without wear or disfiguration.

Other objects of the invention will be made clear or become apparent from the following description and claims when read in light of the accompanying drawing wherein:

DETAILED DESCRIPTION OF THE INVENTION

The present invention is directed to a container holder and the word "container" in intended to be used in the broadest possible sense of any type of receptacle for another material. While the invention will be described primarily with reference to holding a can, it is to be understood that this is merely illustrative and in no way limiting. Cups, bottles and glasses are but a few of the other types of containers which will be equally adaptive for use with the present invention.

Reference will also be made throughout the specification and claims to a "cylindrical container" although the word 'cylindrical' is to be interpreted in a general descriptive sense rather than its normal dictionary meaning. That is to say, any type of container having a generally cylindrical configuration, whether or not the device meets the technical definition of a cylinder, is understood to be within the scope of devices for which the present invention is intended to be used. Many types of soft drink bottles presently marketed and which would be well adapted for use with the present invention are of a generally cylindrical shape although their configuration is not that of a perfect cylinder. The same can be said for most glasses and other drinking utensils commonly utilized.

Figure 1:
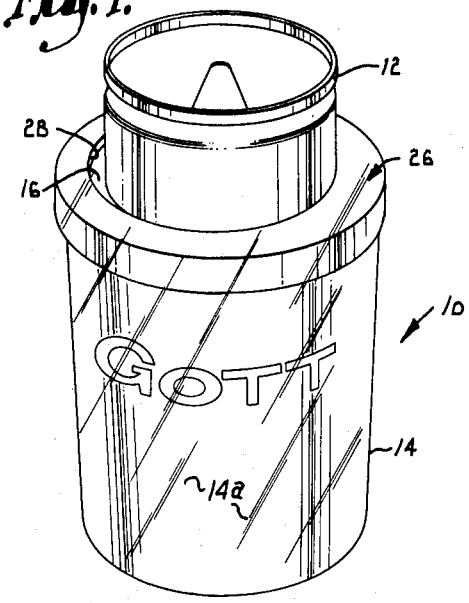
FIG. 1 is a perspective view of the container holder of the present invention.
Figure 2:
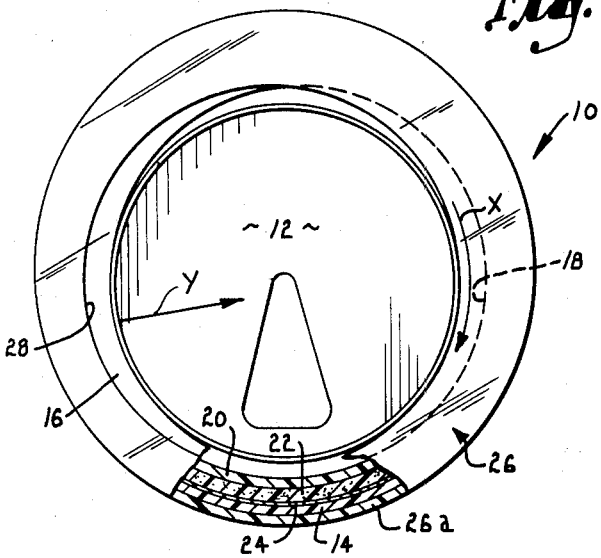
FIG. 2 is a top plan view with portions broken away and shown in cross section for purposes of illustration.
Figure 3:
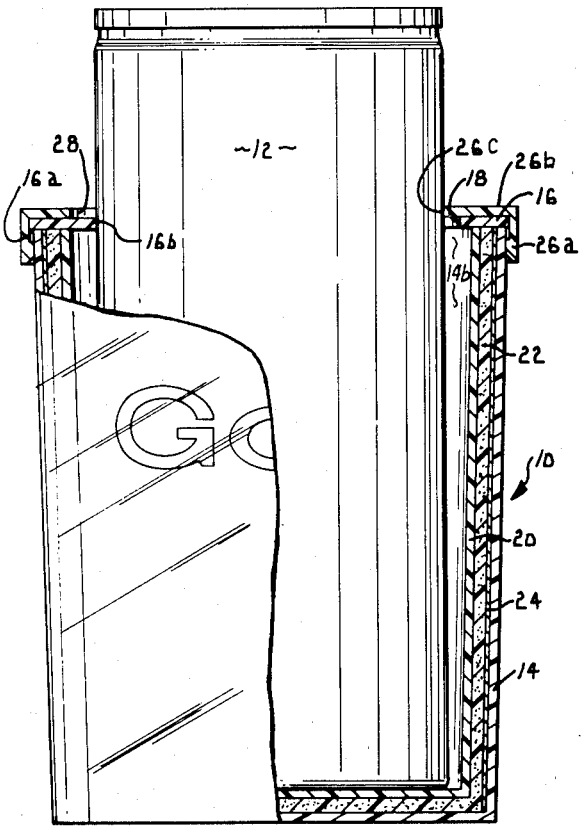
FIG. 3 is an elevational view with a large portion broken away and shown in vertical cross section to illustrate the manner in which one size can is held by the device.

Referring initially to FIGS. 1–3, the device of the present invention is designated generally by the numeral 10 and is designed to hold a generally cylindrical container such as can 12. Device 10 comprises a generally cylindrical upright support 14 which is preferably made of a transparent rigid plastic. Support 14 has a generally circular outside surface **14*a* and a hollow interior 14*b* (FIG. 3). The hollow interior has an internal diameter which can easily accommodate can 12 but is not substantially larger than the can. The hollow interior also represents substantially all of the available area of support 14. That is, the outside diameter of the support is substantially the same as the diameter of interior 14*b*. A generally circular planar ring 16 is rigidly secured to support 14 and presents a top opening 18. Opening 18 generally corresponds in diameter to the diameter of can 12, is generally circular in configuration and is eccentric relative to outside surface 14*a***.

Extending downwardly from ring 16 is an inner liner 20 which is coextensive with and spaced from support 14. The space between inner liner 20 and support 14 is filled with an insulating material such as urethane foam 22. It is also desirable to provide an indicia carrying panel 24 in backing relationship to the vertical wall of support 14 so as to provide a decorative effect or an advertising message such as the word 'GOTT' as shown in FIG. 1.

As best illustrated in FIG. 3, ring 16 has an outside diameter slightly greater than the outside diameter of support 14 so as to present an edge 16*a* at the top of the support. A pivotal collar ring 26 is seated on ring 16 and has a vertical portion 26*a* which extends over edge 16*a* and a lip portion 26*b* which extends perpendicular to the plane of surface 14*a*. Lip portion 26*b* presents an opening 28 of substantially the same size as opening 18. Opening 28 is also circular in configuration and corresponds to opening 18 while being eccentric relative to surface 14*a*. Collar ring 26 is pivotal over surface 14*a* through an arc of at least about 90° so as to move opening 28 from a position aligned and concentric with opening 18 (as shown in FIG. 2) to a non-aligned position (as shown in FIGS. 1 and 3).

The device is used by first aligning openings 18 and 28 and inserting can 12 as illustrated in FIG. 2. As the collar ring 26 is pivoted about surface 14*a* to the position shown in FIG. 3, the leading edge 26*c* of lip 26*b* will engage one side of can 12. The opposite side of the can will be forced against the leading edge 16*b* of ring 16. This applies a force against the can along a line corresponding to the contour of the can so as to lock the can between the lip and edge 16*b*. This line of force is indicated by arrow "X" in FIG. 2. It will be appreciated that, since lip 26*b* pivots through an arc, a person applying a force against the can by turning collar ring 26 has a significant mechanical advantage thereby increasing the effective force tending to lock the can in place. Also, it should be noted that the force of can 12 tending to push back against edge 26*c* extends generally perpendicular from the point of contact. This line of force is represented generally by the arrow "Y" in FIG. 2. In this manner, the can is firmly gripped and locked in place. Enough of the can is allowed to project from the top of support 14 for ease in drinking from the can.

When it is desired to release the can, collar ring 26 is pivoted in the opposite direction so as to again bring openings 18 and 28 into alignment thus allowing quick and easy removal without any damage to the device 10.

Figure 4:
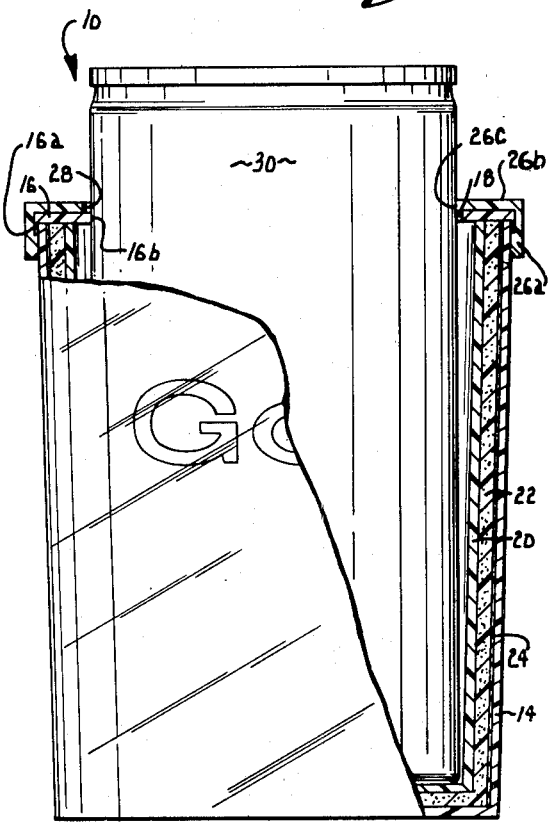
FIG. 4 is a view similar to FIG. 3 illustrating how a slightly shorter and larger diameter can is held.

Openings 18 and 28 are large enough so that when they are in their aligned concentric positions a can 30 of larger diameter than the can 12 may be inserted. The larger can is illustrated in FIG. 4. In the case of a larger can 30, collar 26 is turned through a shorter arc before the can is tightly gripped. Otherwise, operation of the device with the larger can is identical to the preferred embodiment described above.

Figure 5:
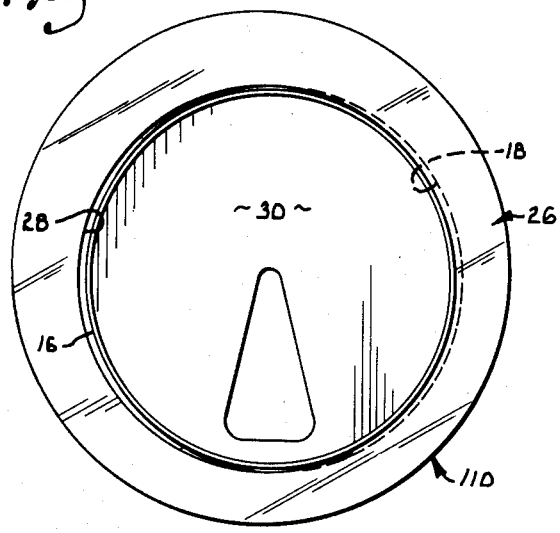
FIG. 5 is a top plan view of an alternative embodiment of the invention.
Figure 6:
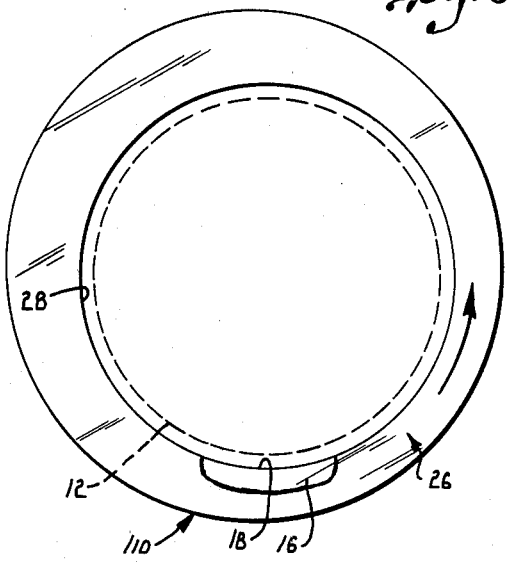
FIG. 6 is another top plan view of the embodiment shown in FIG. 5 with the can removed.
Figure 7:
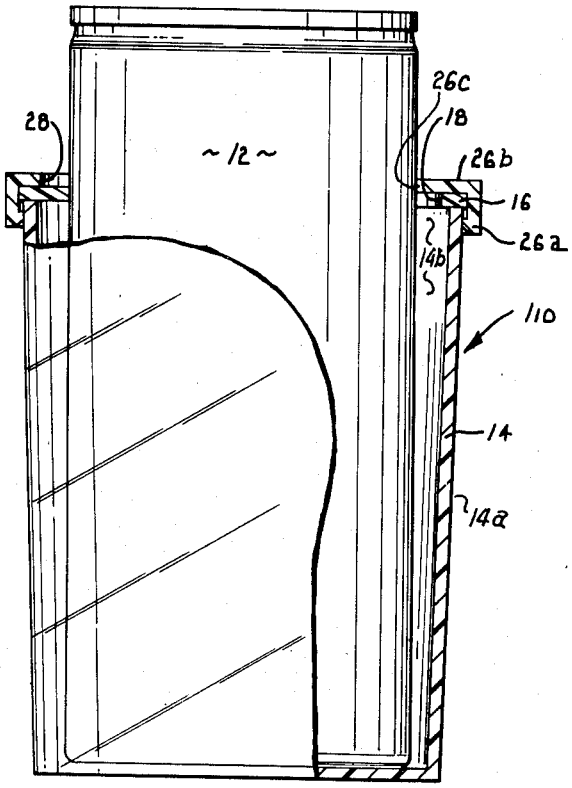
FIG. 7 is an elevational view with major portions shown in vertical cross section illustrating the manner in which the alternative embodiment holds a can.

In the alternative form of the embodiment illustrated in FIGS. 5–7, the device is designated generally by the numeral 110 and again holds a can 12 in the manner previously described. Device 110 is identical in construction to the device 10 described above except for the omission of inner liner 20 and insulating layer 22. This form of the invention is particularly useful where it is desired to see the indicia on the can through the device. The transparent vertical wall of support 14 and the absence of any insulation readily achieves this objective.

It is to be noted that the spacing indicated in FIG. 6 between can 12 and the edges of aligned openings 18 and 28 is exemplary of all embodiments of the invention. The spacing is adequate to accommodate different size containers and allow for easy insertion and removal when the openings are aligned. In this regard, with all embodiments of the invention, the openings 18 and 28 are intended to "generally correspond" to the diameter of can 12. That is to say, while the diameter of these openings is approximately equal to the diameter of the can to be held, the openings will of necessity be somewhat larger than the can. Similarly, while the hollow interior 14*b* is slightly larger in diameter than can 12, it too generally corresponds to the diameter of the can. Thus, the term "generally corresponds" is intended to mean of approximately the same size without any specific tolerance limits.

It is to be appreciated that even with the utilization of inner liner 20, it is possible to omit insulating layer 22.

It is believed that the invention described above accomplishes for the first time the objectives heretofore set forth and offers many advantages over prior art devices used for similar purposes.

Having thus described the invention, I claim:

1. A device for holding a cylindrical container, said device comprising:

a generally cylindrical upright support, said support having a generally circular outside surface and a hollow interior for receiving said container, said hollow interior having an internal diameter of a size to accommodate said container, said interior being further characterized by occupying substantially all of the area of said cylindrical support;

means for presenting an opening in the top of said support corresponding in diameter to the diameter of said container, said opening being further characterized by being eccentric relative to said outside surface;

ring means mounted for pivotal movement over said outside surface and presenting a lip extending perpendicular to the plane of said surface, said lip presenting an opening corresponding to the opening in the top of said support, said lip opening being eccentric relative to said outside surface and being movable from a first position wherein said openings are aligned to a second nonaligned position wherein said lip engages said container to exert a force against said container along a line corresponding to the contour of said container thereby locking said container between said lip and said means presenting the first-mentioned opening.

2. A device as set forth in claim 1, wherein each of said openings is substantially circular.

3. A device as set forth in claim 1, wherein is included a liner extending downwardly from the means presenting the first mentioned opening, said liner being coextensive with and spaced from said support.

4. A device as set forth in claim 3, wherein the space between said liner and said support is filled with insulating material.

5. A device as set forth in claim 1, wherein said means presenting said opening in the top comprises a planar member.

6. A device as set forth in claim 5, wherein said support is covered with a layer of insulation material.

7. A device as set forth in claim 1, wherein said support is substantially transparent and the inside of said support is provided with indicia.

8. A device for holding a cylindrical container, said device comprising:

a generally cylindrical upright support;

means coupled with said support and presenting an opening in the top of said support, said opening being eccentric relative to the center of said support;

means presenting an overhanging edge extending around said support at said top opening, pivotal cap means including a lip portion for engagement with said edge to couple the cap means with the support, said cap means presenting an eccentric opening of substantially the same size as the first mentioned opening, said pivotal means being movable from a first position wherein said openings are in substantial concentric alignment for receiving said container to a second non-aligned position wherein said container is gripped between the means presenting the top opening and said pivotal means.

* * * * *